US006085480A

United States Patent [19]

Baldwin

[11] Patent Number: 6,085,480

[45] **Date of Patent: *Jul. 11, 2000**

[54] BUILDING BLOCK HAVING A WOODEN ATTACHMENT LAYER

[76] Inventor: Robert A. Baldwin, 17440 N. Tatum, #327, Phoenix, Ariz. 85032

[ * ] Notice: This patent is subject to a terminal disclaimer.

[21] Appl. No.: 08/953,569

[22] Filed: Oct. 17, 1997

Related U.S. Application Data

[63] Continuation-in-part of application No. 08/852,922, May 8, 1997, Pat. No. 5,913,791.

[51] Int. Cl.[7] ..... E04C 1/40

[52] U.S. Cl. ..... 52/612; 52/422; 52/437; 52/605; 52/607

[58] Field of Search ..... 52/422, 437, 439, 52/605, 606, 607, 612

[56] References Cited

U.S. PATENT DOCUMENTS

| | | | |
|---|---|---|---|
| 377,098 | 1/1888 | Duffy . | |
| 729,918 | 6/1903 | Braun . | |
| 1,360,183 | 11/1920 | Cosgrove . | |
| 1,582,735 | 4/1926 | Cooper . | |
| 1,678,628 | 6/1928 | Ashenhurst . | |
| 1,683,441 | 9/1928 | Bone . | |
| 1,781,234 | 11/1930 | Jones . | |
| 2,701,959 | 2/1955 | Briggs . | |
| 3,545,152 | 12/1970 | Knohl . | |
| 3,775,240 | 11/1973 | Harvey . | |
| 4,295,313 | 10/1981 | Rassias . | |
| 4,319,440 | 3/1982 | Rassias et al. . | |
| 4,478,021 | 10/1984 | Person | 52/612 X |
| 4,480,416 | 11/1984 | Judkins et al. . | |
| 4,532,745 | 8/1985 | Kinard . | |
| 4,573,301 | 3/1986 | Wilkinson . | |
| 4,584,897 | 4/1986 | Bear . | |
| 4,612,744 | 9/1986 | Shamash . | |
| 4,856,244 | 8/1989 | Clapp . | |
| 5,074,088 | 12/1991 | Bergeron et al. . | |
| 5,143,670 | 9/1992 | De Buzzaccarini | 264/256 X |
| 5,724,783 | 3/1998 | Mandish | 52/745.05 |
| 5,729,942 | 3/1998 | Moore, Jr. | 52/437 |
| 5,788,423 | 8/1998 | Perkins | 52/612 X |

FOREIGN PATENT DOCUMENTS

| | | |
|---|---|---|
| 132021 | 4/1949 | Australia . |

*Primary Examiner*—Robert E. Chilcot, Jr.
*Attorney, Agent, or Firm*—Martin & Associates, L.L.C.; Derek P. Martin

[57] ABSTRACT

A concrete-based building block has an integrally-formed wooden attachment layer on one or both exterior surfaces of the block that can receive and hold a penetrating fastener such as a nail, screw, staple, or the like. This allows surficial coverings such as wallboard, siding or other materials to be easily attached to a block wall made of the building blocks. The block includes substantially semi-cylindrical concave portions that form a cross-linked structure of channels when the blocks are assembled into a wall. Once the blocks have been stacked in place in a wall, grout or other suitable filling material is poured into the cross-linked structure of channels. When the filling material hardens, the blocks are locked together. Surficial covering materials may then be nailed, screwed, or stapled directly to the attachment layer of the blocks.

16 Claims, 5 Drawing Sheets

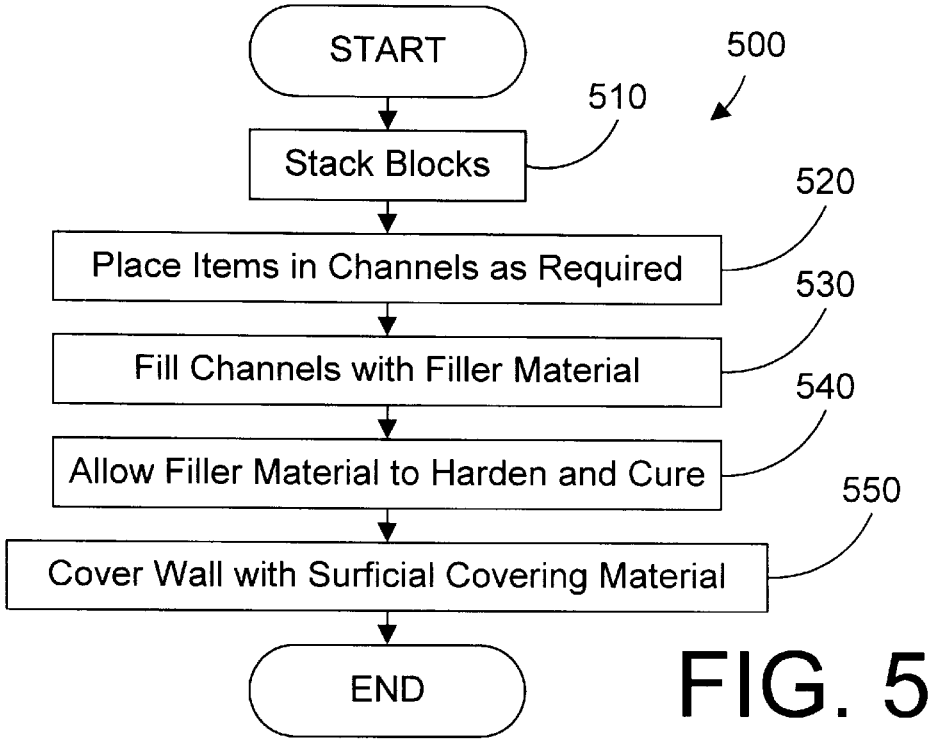
FIG. 5
FIG. 8
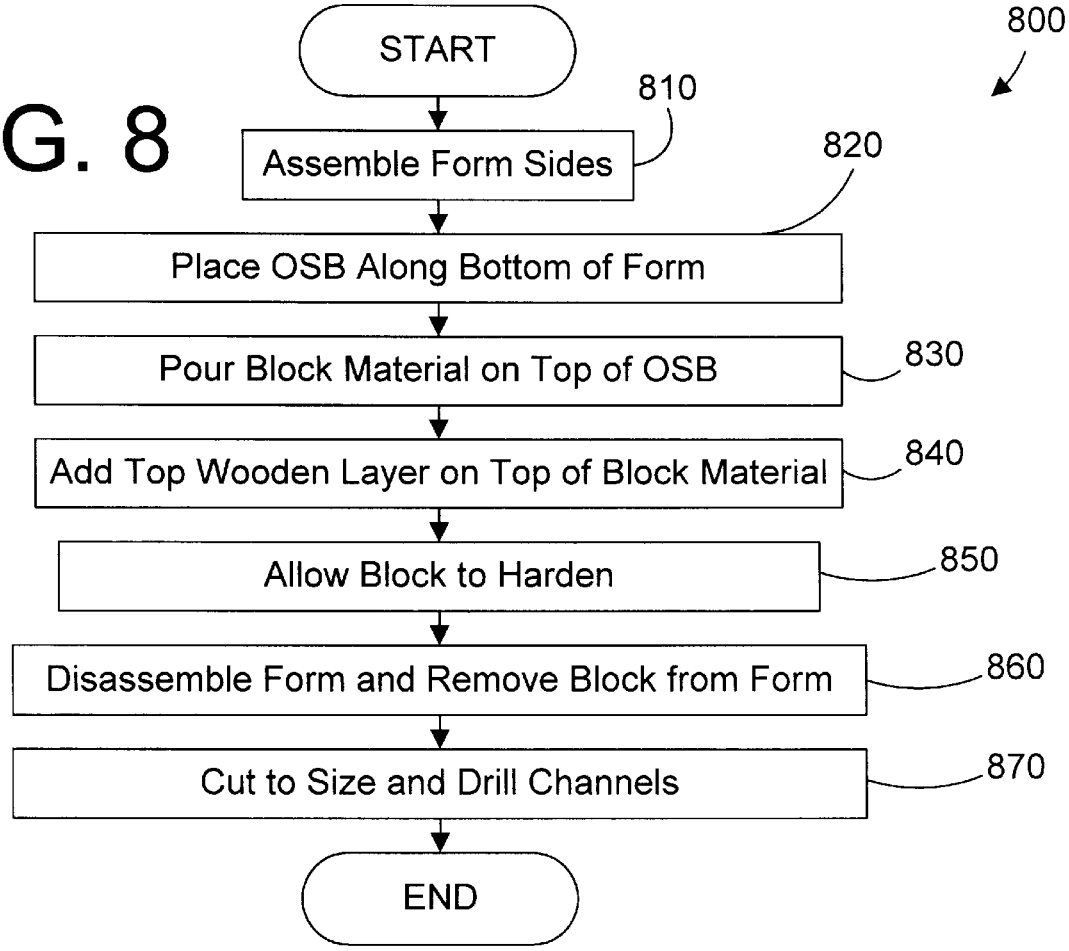

BUILDING BLOCK HAVING A WOODEN ATTACHMENT LAYER

PARENT APPLICATION

This patent application is a continuation-in-part of my previously filed patent application entitled "BUILDING BLOCK, METHOD FOR MAKING THE SAME, AND METHOD FOR BUILDING A WALL USING THE SAME", U.S. Ser. No. 08/852,922, filed May 8, 1997 now U.S. Pat. No. 5,913,791.

BACKGROUND OF THE INVENTION

1. Technical Field

This invention generally relates to construction materials and techniques, and more specifically relates to a building block, a method for making the building block, and a method for building a wall using the building block.

2. Background Art

Building blocks have been used for centuries to construct homes, office buildings, churches, and many other structures. Early building blocks were hewn from stone into appropriate shapes that were assembled together, typically using mortar, to form a wall. In modern times, various types of concrete blocks were developed, which are typically formed by pouring a cement mixture into a form and allowing the cement to harden. This type of cement block is strong and makes for a sturdy wall, but installing a traditional concrete block requires a skilled mason that places mortar in all joints between blocks to secure the blocks in place.

Various different block configurations have been developed that allow mortar to be poured into inner passageways of the blocks once the blocks have been constructed into a wall. Some of these eliminate the need for a mason to apply mortar between the blocks as the blocks are laid because the blocks are interlocked using mortar poured into interior passages. Examples of blocks with inner passages are found in U.S. Pat. No. 4,295,313, "Building Blocks, Wall Structures Made Therefrom, and Methods of Making the Same", issued Oct. 20, 1981 to Rassias; U.S. Pat. No. 4,319,440, "Building Blocks, Wall Structures Made Therefrom, and Methods of Making the Same", issued Mar. 16, 1982 to Rassias; U.S. Pat. No. 2,701,959, "Sectional Block Masonry", issued Feb. 15, 1955 to Briggs; and Swiss Patent No. 354237, issued Jun. 30, 1961.

One significant drawback of using concrete blocks to form walls in a structure is that surficial covering material often needs to be applied to the surface of the walls. Many common surficial coverings for walls are attached using nails or screws. For example, siding may need to be applied to the outside of the wall, and wallboard, paneling, or other sheet material may need to be applied to the inside of the wall. Known concrete blocks are too hard and brittle to allow commonly-used nails or screws to be used to attach a surficial covering material. As a result, special concrete nails or anchors are typically used to secure wood furring strips or studs to the concrete block wall, and the covering materials are, in turn, fastened to the furring strips or studs. This process of fastening wood furring strips or studs to the block wall and nailing on the covering material to the furring strips is time-consuming, and the concrete blocks do not hold the nails or anchors in place very well. It is not uncommon for one or more of the concrete nails to become loose when a surficial material is nailed in place, compromising the structural integrity of the wall.

Therefore, there existed a need to provide an improved building block with an attachment layer that allows covering materials to be directly attached to the building blocks using conventional nails, screws, or staples.

DISCLOSURE OF INVENTION

According to the present invention, a building block has a wood attachment layer integrally formed into one or both exterior surfaces of the block that can receive and hold a penetrating fastener such as a nail, screw, staple, or the like. This allows surficial coverings such as wallboard, siding or other materials to be easily attached to a block wall made of the building blocks. The block includes substantially semi-cylindrical concave portions that form a cross-linked structure of channels when the blocks are assembled into a wall. Once the blocks have been stacked in place in a wall, grout or other suitable filling material is poured into the cross-linked structure of channels. When the filling material hardens, the blocks are locked together. Surficial covering materials may then be nailed, screwed, or stapled directly to the wooden attachment layer.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and:

FIG. 5 is a flow diagram of a method for building a wall in accordance with the preferred embodiments using the block of FIG. 1;

FIG. 8 is a flow diagram of a method for forming the block of FIG. 1;

BEST MODE FOR CARRYING OUT THE INVENTION

The building block of the present invention allows any suitable material to be directly fastened (e.g., screwed, nailed, or stapled) to it. A wood attachment layer on the block allows fasteners to be directly attached to the block.

Figure 1:
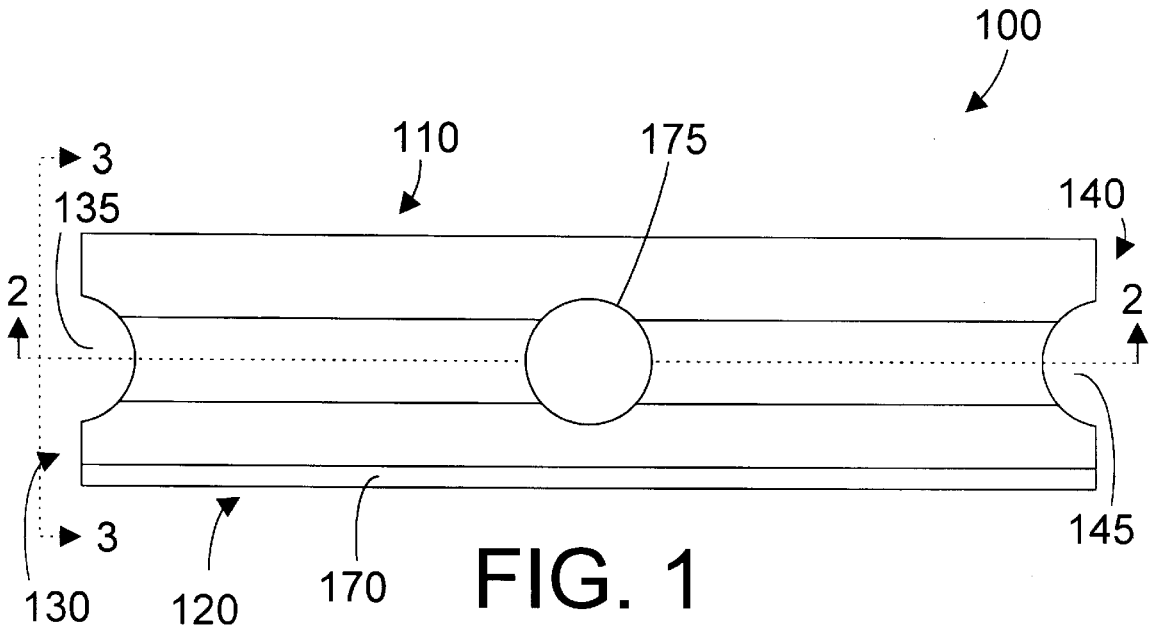
FIG. 1 is a top view of a building block in accordance with the present invention.
Figure 2:
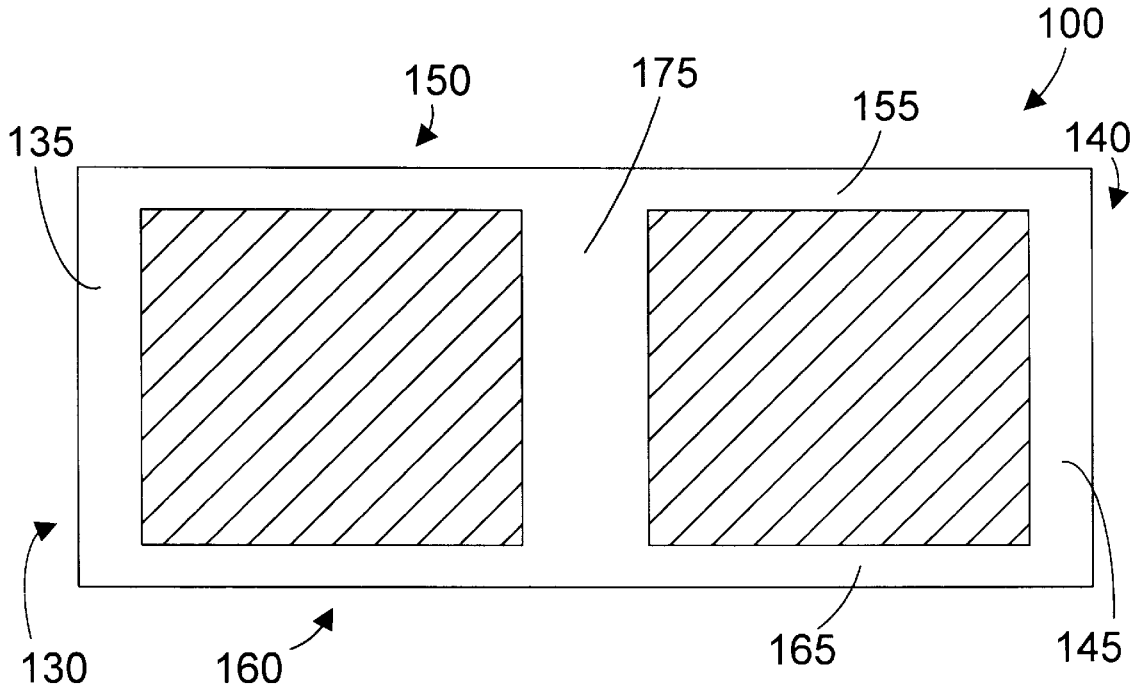
FIG. 2 is a cross-sectional view of the block of FIG. 1 taken along the lines 2—2.
Figure 3:
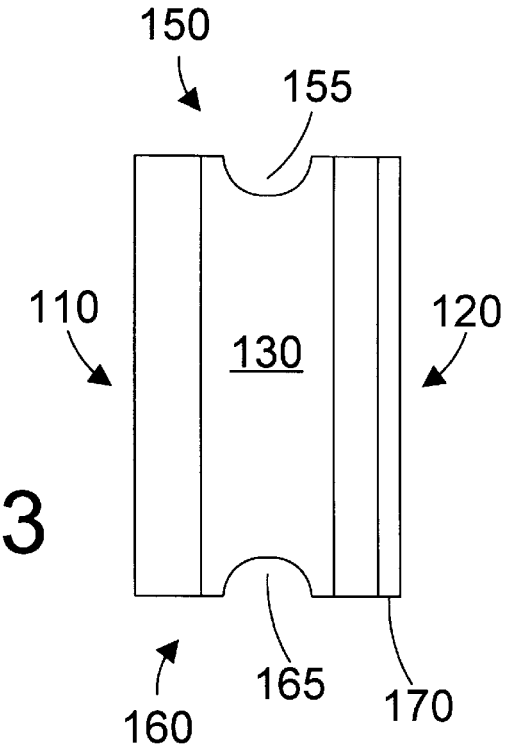
FIG. 3 is a side view of the block of FIG. 1 taken along the lines 3—3.
Figure 4:
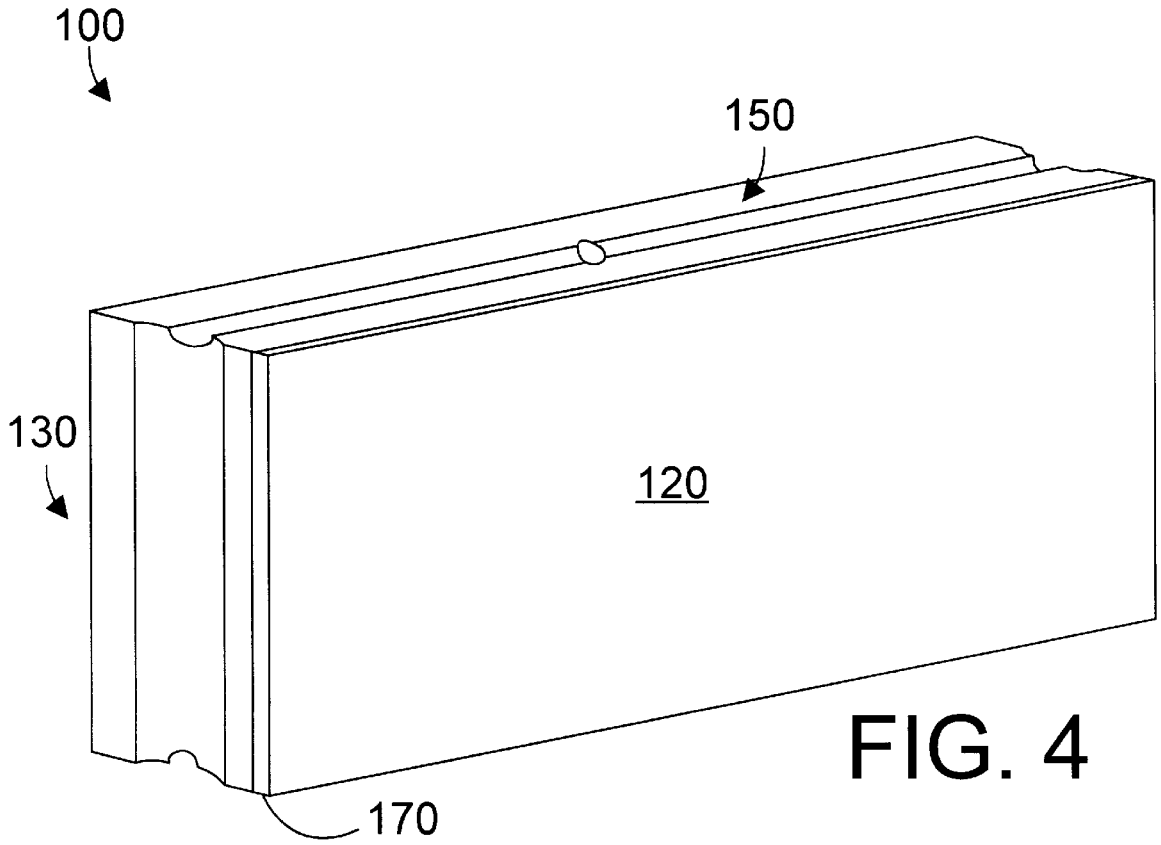
FIG. 4 is a perspective view of the block of FIG. 1.

Referring now to FIGS. 1–4, a building block 100 in accordance with the preferred embodiment includes a first exterior surface 110, a second exterior surface 120, a first side surface 130, a second side surface 140, a top surface 150, and a bottom surface 160. Either or both of the first exterior surface 110 and the second exterior surface 120 include an attachment layer 170. For purposes of illustrating the attachment layer 170 in the Figures, attachment layer 170 in FIG. 1 is shown on exterior surface 120. Note, however, that attachment layer 170 may be located on either or both of the exterior surfaces 110 and 120.

Each of the side surfaces 130 and 140, the top surface 150, and the bottom surface 160 include corresponding substantially semi-cylindrical concave portions 135, 145, 155 and 165. In addition, block 100 further includes a cylindrical channel 175. These concave portions and cylindrical channel of one block align with similar concave portions and cylindrical channels on adjacent blocks to form a cross-linked structure of substantially cylindrical channels when the building blocks are assembled into a wall. These channels preferably have a circular cross-section, but may have other geometries within the scope of the present invention.

Block 100 is preferably comprised of a mixture of cement, water, an acrylic fortifier, and a suitable insulative material. The cement is preferably Portland cement, type 1, ASTM designation C150 or similar. The preferred acrylic fortifier Quikrete Concrete Acrylic Fortifier #8610, available from the Quikrete Companies, 2987 Clairmont Road, Suite 500, Atlanta, Ga., 30329. The preferred insulative material is a synthetic bead material with a suitable diameter less than 2.54 cm (1 inch), a preferable diameter less than 1.27 cm (0.5 inch), and a most preferred diameter of 3.18 mm (⅛ inch) to 9.53 mm (⅜ inch). The insulative material may be any suitable insulative material, such as polyurethane, polycyanuarate, betostyrene, etc. The preferred insulative material is expanded polystyrene (EPS) foam beads. The best mode of the invention uses a mixture of different bead sizes ranging from 3.18 mm (⅛ inch) to 9.53 mm (⅜ inch). The proportions of water, cement, and EPS foam beads for the block mix are suitably 18.1 to 31.8 kilograms (kg) (40 to 70 lb) water to 31.8 to 52.2 kg (70 to 115 lb) cement to 0.47 to 0.94 liters (2 to 4 cups) acrylic fortifier to 227 to 341 liters (60 to 95 gallons) EPS foam beads. The preferred proportions for the block mix are 20.4 to 29.5 kg (45 to 65 lb) water to 36.3 to 47.6 kg (80 to 105 lb) cement to 0.59 to 0.83 liters (2.5 to 3.5 cups) acrylic fortifier to 265 to 303 liters (70 to 80 gallons) EPS foam beads. The proportions in accordance with the best mode of the invention for the block are most preferably 25.0 kg (55 lb) water to 42.6 kg (94 lb) cement to 0.71 liters (3 cups) acrylic fortifier to 284 liters (75 gallons) EPS foam beads.

In the preferred embodiment, the attachment layer 170 is Oriented Strand Board (OSB). OSB is relatively inexpensive and adheres well to a cement-based mixture. However, any suitable wood or other product may be used that will adhere to concrete and provide the required penetrating and holding properties that allow attachment layer 170 to receive and hold penetrating fasteners in place.

Note that the ranges specified herein are believed to be workable ranges for the various ingredients in the block mix. However, it is possible that certain combinations within the ranges specified would not produce a block with the desired strength. Different formulations within the specified ranges are possible that will produce different properties of the resultant block.

Figure 6:
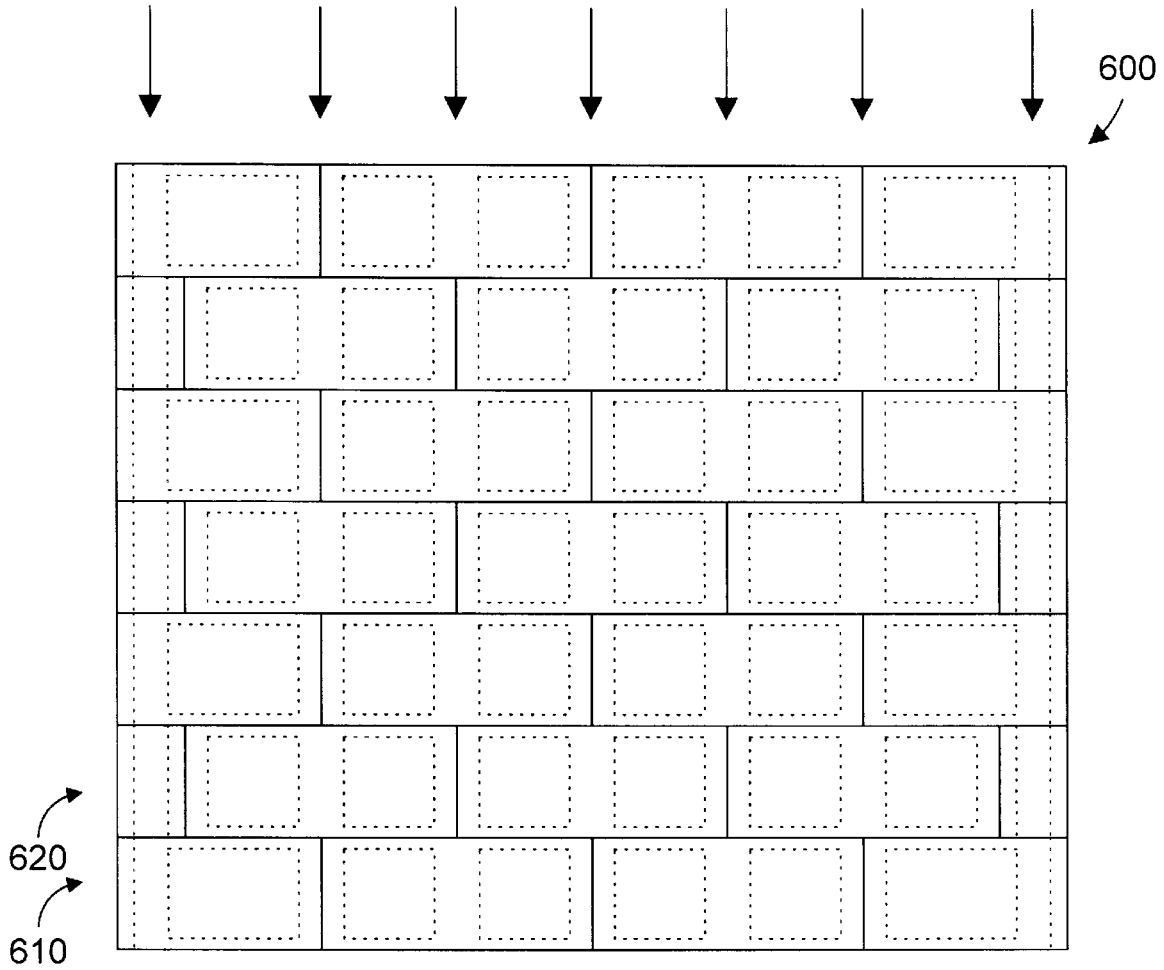
FIG. 6 is a front view of a block wall in accordance with the preferred embodiment
Figure 7:
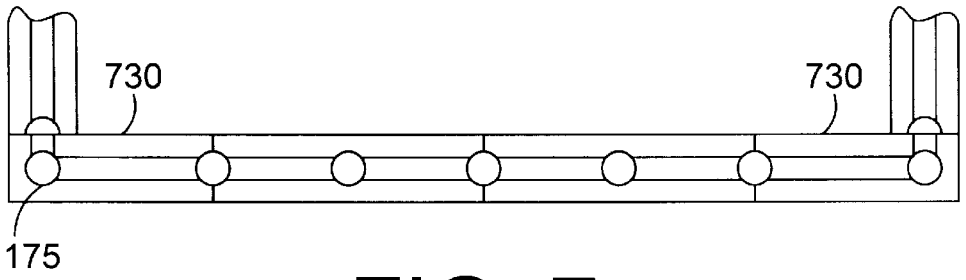
FIG. 7 is top view of the wall of FIG. 6.

Referring now to FIGS. 5–7, a method 500 for building a wall 600 using a plurality of blocks 100 begins by stacking the blocks (step 510). Block 100 is designed so that a wall is built by putting down a first course (or row) 610 of blocks end-to-end without mortar, then stacking the second course of blocks 620 on the first course of blocks without mortar in staggered fashion so that each block in the second course overlaps two blocks in the first course. Referring to FIGS. 1–4, with blocks 100 stacked to form a wall as shown in FIG. 6, the concave portions 135 and 145 of corresponding side portions 130 and 140 of a block in the course above are aligned above cylindrical channels 175 in the blocks below, and the concave portions 135 and 145 of corresponding side portions 130 and 140 of the lower blocks are aligned below the cylindrical channel 175 of the blocks above.

Note that if the blocks have a single attachment layer on one exterior surface (110 or 120), the attachment layer 170 of each block must be aligned with the side of the wall where the attachment layer is needed during the stacking of the blocks in step 510. Of course, if an attachment layer 170 is present on both exterior surfaces 110 and 120, no such alignment is required.

During the stacking of the blocks 100, various items may be placed within the cross-linked structure of channels as required (step 520). For example, electrical cable, water and waste pipes, gas pipes, and reinforcing steel bar (known as rebar) may be put within the channels. These channels provide natural passageways for routing these items to their desired locations. Openings from the channels to the exterior of the block may be made using a drill, router, saw, or any other suitable tool to accommodate the exit points for plumbing, electrical wires, and the like.

Once two or more courses are stacked in place, with the desired rebar, cable, and/or pipes in place within the channels, a suitable filler material is then poured into the exposed openings at the top of the blocks (step 530). The preferred filler material is a cement-based grout that has a plastic consistency that allows it to flow by the force of gravity to fill all of the channels in the blocks. The grout material is referred to herein as a plastic material, not because the grout contains any plastic, but because the grout, when wet, has plastic properties. Suitable grout typically has a slump of 20.3–25.4 cm (8–10 inches). The best mode formulation for the grout is 298.5 kg (658 lb) cement to 170.1 kg (375 lb) water to 1,270 kg (2800 lb) aggregate, where the aggregate is preferably 75% sand and 25% pea gravel no greater than 1.3 cm (½ inch) in diameter. Note that the consistency of the filler material must allow the filler material to flow around all items located in the channels. Of course, many suitable filler materials other than grout may be used within the scope of the present invention. For example, a variety of injected foam, plastic, adhesive, or epoxy compounds would be suitable filler materials. In the preferred method of constructing a wall using blocks 100, the blocks for the entire wall are stacked in place (step 510) and all of the required items are routed in the channels (step 520) before the filler material is added (step 530). In this manner the filler material need only be poured once after all of the blocks for the wall are in place (as shown by the arrows in FIG. 6), rather than by pouring at different levels as the wall goes up.

Building a block wall 600 in accordance with method 500 requires corner blocks 730 that are different than the block 100 of FIG. 1 that is used in the middle of wall 600. These differences must be present to ensure that the resulting cross-linked structure of substantially cylindrical channels is closed within the wall 600 so that there is no open access from the channels to outside the wall, except for the openings at the top of the wall. A closed system will assure that no filler material that is poured into the network of channels will spill out. As a result, as the filler material fills the channels, the pressure from the material causes the filler material to fill the voids in the channels. As shown in FIG. 7, the semi-cylindrical concave portions of the corner blocks 730 do not extend from one side of the block to the other, but make a right-angle turn toward the adjacent wall. Corner blocks 730 have the same width and height as block 100, and have a preferred length that is the sum of the width of the block plus half the length of the block. In the preferred embodiment, block 100 has a width of 30.5 cm (12 inches), a height of 40.6 cm (16 inches), and a length of 122 cm (48 inches), so corner block 730 has a width of 30.5 cm (12 inches), a height of 40.6 cm (16 inches), and a length of 91.4 cm (36 inches).

After the filler material is poured in place (step 530), it is allowed to harden and cure (step 540). Once the filler material has cured, any suitable surficial covering material may be attached to the exposed attachment layer 170 using any suitable fastener that at least partially penetrates attachment layer 170 (step 550). For example, if the interior side of an exterior wall 600 has an attachment layer 170, any suitable wall material (such as wallboard and paneling) may be directly nailed, stapled, or screwed to the attachment layer 170. Likewise, if the exterior side of an exterior wall has an attachment layer 170, any suitable exterior covering material (such as siding) may be directly nailed, stapled, or screwed to the attachment layer 170. Allowing a wall covering material to be directly fastened to wall 600 using standard fasteners eliminates the time and expense of furring out the walls with wood members.

Figure 9:
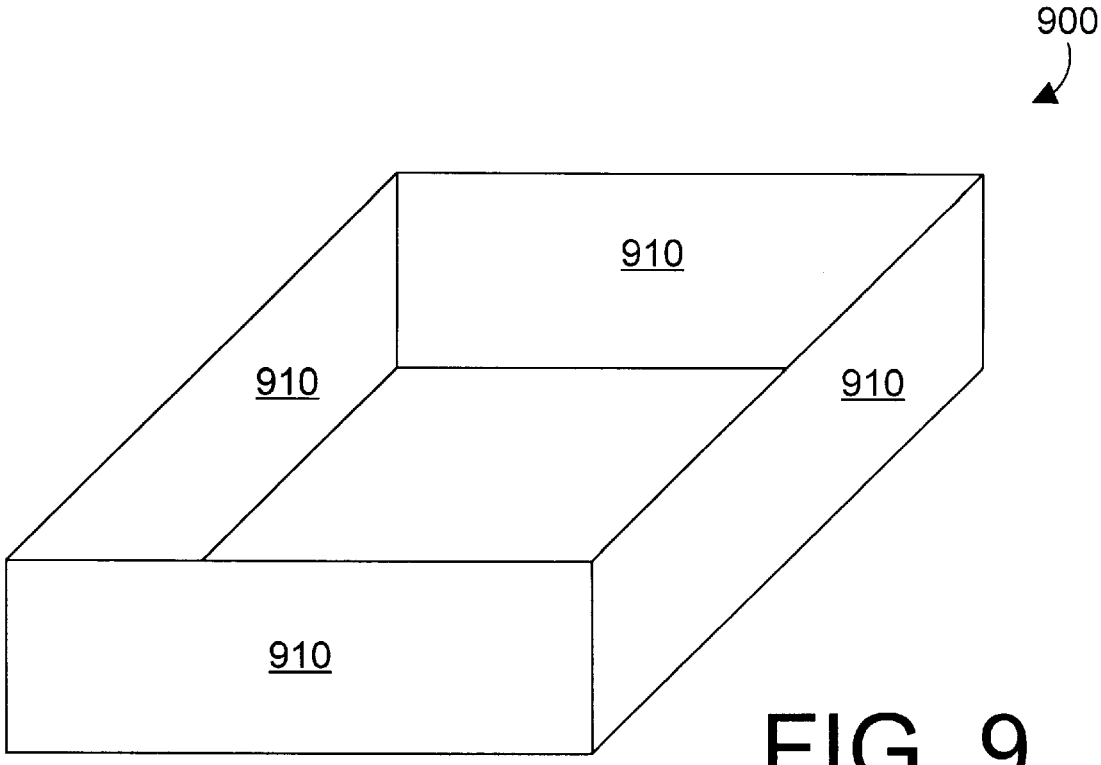
FIG. 9 is a perspective view of a form for forming the block of FIG. 1.
Figure 10:
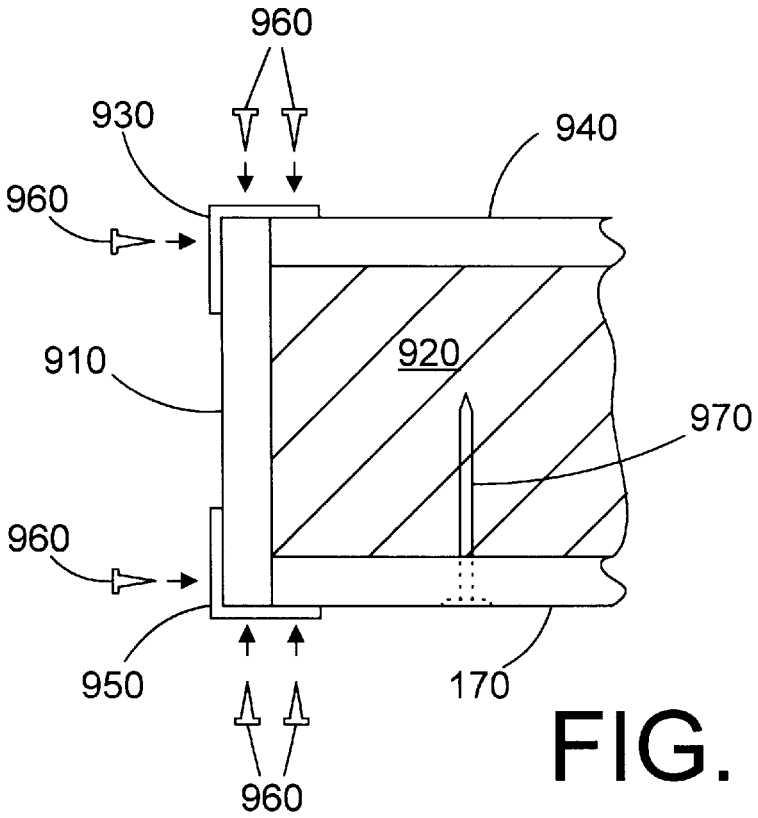
FIG. 10 is a cross-sectional view of an assembled form for forming the block of FIG. 1.

Referring now to FIGS. 8–10, a method 800 for forming a block 100 (of FIG. 1) uses a form 900. Form 900 has side portions 910 that are attached to each other using screws or other suitable fasteners. The side portions 910 of form 900 are all preferably coated with a non-stick substance to ensure that the block does not stick to the form. Examples of suitable non-stick coatings include wax, form oil, teflon, etc.

The first step in method 800 is to assemble the form sides 910 (step 810) to create an open box as shown in FIG. 9. Each side portion is attached to the adjacent side portion to hold the form in place. Next, the attachment layer 170 is dropped within the sides 910 (step 820) to form the bottom of an open box structure. As stated above, the preferred attachment layer 170 is OSB. Attachment layer 170 is suitably secured to all side panels 910. As shown in FIG. 10, in the preferred embodiment, a bracket 950 with screws 960 are used to attach attachment layer 170 to side portions 910. Note that attachment layer 170 may include one or more retaining devices 970 that are attached to attachment layer 170 and that protrude into the interior space of form 900. Suitable retaining devices include aluminum ring-shank spikes, 50d galvanized nails, tile nails, and screws, but any device that is attached to attachment layer 170 and that extends into the interior space of form 900 may be used as a retaining device. The material for the block is then poured on top of the attachment layer material (step 830). Block material 920 is added to the form in step 830 and is then leveled off to a desired predetermined depth. A top wooden layer 940 is then placed atop the block material 920 (step 840). In the preferred embodiment, block material 920 is leveled off at a depth that is less than the depth of the top wooden layer 940. For example, if a 1.91 cm (¾ inch) thick top wooden layer 940 is placed atop block material 920, the block material is suitably leveled off at 0.64 cm (¼ inch) below the top surface of the side portions 910. Thus, when top wooden layer 940 is placed atop the block material 920, it sits approximately 1.27 cm (½ inch) above the top of side portions 910. A bracket 930 is then placed on the joint between top wooden layer 940 and side portion 910, and screws 960 are driven into each through the bracket, causing top wooden layer 940 to compress the block material by approximately 1.27 cm (½ inch). Compressing block material 920 helps eliminate voids in block material 920 and achieves a more desirable and uniform surface texture.

Next the block material 920 is allowed to harden (step 850). For the preferred embodiments disclosed herein, block material 920 is cement-based, and therefore hardens through hydration. Once block material 920 has hardened, the form is disassembled and the hardened block material is removed from the form (step 860). The form is disassembled by removing side portions 910 from the block material, and by removing the top wooden layer 940 if the block has only one attachment layer 170. The block material is then cut to the appropriate size to form a plurality of blocks, and each block is drilled to create center channel 175 and semi-cylindrical channels 135, 145, 155 and 165 (step 870), and the fabrication of the blocks is complete.

In the best mode of the invention, block 100 has a length of 122 centimeters (cm) (48 inches), a width of 30.5 cm (12 inches), and a height of 40.6 cm (16 inches). The diameter of the cylindrical channel 175 is 12.7 cm (5 inches), the vertical semi-cylindrical concave portions 135 and 145 each have a diameter of 12.7 cm (5 inches), and the horizontal semi-cylindrical concave portions 155 and 165 each have a diameter of 7.6 cm (3 inches). The dimensions of block 100 allow a wall to be quickly and efficiently constructed, and the dimensions of the channels help assure that filler material will flow around any items (such as pipe, rebar, cables, etc.) that are placed within the channels. Form 900 has interior dimensions of 121.9 cm (48 inches) by 243.8 cm (96 inches) to accommodate a full sheet of OSB or other wooden material within side portions 910. The height of side portions 910 is preferably 30.5 cm (12 inches). The form thus produces a block of material that is 122 cm (48 inches) by 244 cm (96 inches) by 30.5 cm (12 inches). The block of material is cut into 40.6 cm (16 inch) widths along its 122 cm (48 inch) dimension to yield six blocks that are each 122 centimeters (cm) (48 inches) long by 30.5 cm (12 inches) wide by 40.6 cm (16 inches) high. The block of material may be cut into individual blocks using a band saw or any other suitable cutting machine or device. In the preferred embodiment, the block of material is placed on a roller table and is fed through a set of five saw blades that cut the block of material into six equal portions, each of which becomes a single block after subsequent drilling.

While the invention has been particularly shown and described with reference to preferred embodiments thereof, it will be understood by those skilled in the art that various changes in form and details may be made therein without departing from the spirit and scope of the invention. For example, a block may be made in a variety of different sizes. In addition, the size, number and geometries of the channels 175 and concave portions 135, 145, 155 and 165 may vary from that disclosed herein. In addition, while a method for forming the block 100 disclosed herein has a step for drilling out cylindrical channel 175 and semi-cylindrical channels 135, 145, 155 and 165 (step 870 of FIG. 8), these channels could also be formed during the fabrication of block 100 by inserting one or more pipe members into form 900 before pouring in the block mix. These pipe members could remain in the block, or could be coated with a non-stick surface so they may be removed once the block is formed.

What is claimed is:

1. A building block comprising:

a first exterior surface;

first and second side surfaces coupled to the first exterior surface;

a top surface coupled to the first exterior surface and to the first and second side surfaces;

a bottom surface coupled to the first exterior surface and to the first and second side surfaces;

a second exterior surface coupled to the first and second side surfaces, to the top surface, and to the bottom surface;

a wooden attachment layer integrally formed within and substantially covering at least one of the first and second exterior surfaces;

wherein the building block comprises a mixture of water, cement, acrylic fortifier, and insulative material, wherein the insulative material comprises expanded polystyrene foam beads that have a diameter from 3.18 mm (⅛ inch) to 9.53 mm (⅜ inch).

2. The building block of claim 1 wherein the wooden attachment layer comprises oriented strand board (OSB).

3. The building block of claim 1 further comprising at least one substantially cylindrical passage extending from the top surface to the bottom surface.

4. A building block comprising:

a first exterior surface;

first and second side surfaces coupled to the first exterior surface;

a top surface coupled to the first exterior surface and to the first and second side surfaces;

a bottom surface coupled to the first exterior surface and to the first and second side surfaces;

a second exterior surface coupled to the first and second side surfaces, to the top surface, and to the bottom surface;

a wooden attachment layer integrally formed within and substantially covering at least one of the first and second exterior surfaces;

wherein the building block comprises a mixture of water, cement, acrylic fortifier, and insulative material in the proportions of:

approximately 24.95 kg (55 lb) water;

approximately 42.64 kg (94 lb) cement;

approximately 0.71 liters (3 cups) acrylic fortifier; and approximately 283.9 liters (75 gallons) insulative material.

5. The building block of claim 4 wherein:

each first and second side surface comprises a substantially semi-cylindrical concave portion;

the top surface comprises a substantially semi-cylindrical concave portion; and the bottom surface comprises a substantially semi-cylindrical concave portion;

the substantially semi-cylindrical concave portions forming a cross-linked structure of substantially cylindrical channels when a plurality of the building blocks are assembled into a wall.

6. The building block of claim 4 wherein the wooden attachment layer comprises oriented strand board (OSB).

7. The building block of claim 4 further comprising at least one substantially cylindrical passage extending from the top surface to the bottom surface.

8. A building block comprising:

a first exterior surface;

first and second side surfaces coupled to the first exterior surface, each first and second side surface comprising a substantially semi-cylindrical concave portion;

a top surface coupled to the first exterior surface and to the first and second side surfaces, the top surface comprising a substantially semi-cylindrical concave portion extending between the first and second side surfaces;

a bottom surface coupled to the first exterior surface and to the first and second side surfaces, the bottom surface comprising a substantially semi-cylindrical concave portion extending between the first and second side surfaces;

a second exterior surface coupled to the first and second side surfaces, to the top surface, and to the bottom surface;

each of the first and second side surfaces and the top and bottom surfaces comprising a mixture in the proportions of:

approximately 24.95 kg (55 lb) water;

approximately 42.64 kg (94 lb) cement;

approximately 0.71 liters (3 cups) acrylic fortifier; and approximately 283.9 liters (75 gallons) expanded polystyrene foam beads with a diameter from 3.18 mm (⅛ inch) to 9.53 mm (⅜ inch);

a wooden attachment layer integrally formed within and substantially covering at least one of the first and second exterior surfaces; and at least one retaining device attached to the wooden attachment layer and attached to the mixture to fixedly hold the attachment layer to the mixture.

9. The building block of claim 8 wherein the wooden attachment layer comprises oriented strand board (OSB).

10. The building block of claim 8 further comprising at least one substantially cylindrical passage extending from the top surface to the bottom surface.

11. A building block comprising:

a first exterior surface;

first and second side surfaces coupled to the first exterior surface;

a top surface coupled to the first exterior surface and to the first and second side surfaces;

a bottom surface coupled to the first exterior surface and to the first and second side surfaces;

a second exterior surface coupled to the first and second side surfaces, to the top surface, and to the bottom surface;

a wooden attachment layer integrally formed within and substantially covering at least one of the first and second exterior surfaces;

wherein the building block comprises a mixture of water, cement, acrylic fortifier, and insulative material in the proportions of:

18.1 to 31.8 kilograms (kg) (40 to 70 lb) water;

31.8 to 52.2 kg (70 to 115 lb) cement;

0.47 to 0.94 liters (2 to 4 cups) acrylic fortifier; and 227 to 341 liters (60 to 95 gallons) insulative material.

12. The building block of claim 11 wherein the wooden attachment layer comprises oriented strand board (OSB).

13. The building block of claim 11 further comprising at least one substantially cylindrical passage extending from the top surface to the bottom surface.

14. A building block comprising:

a first exterior surface;

first and second side surfaces coupled to the first exterior surface;

a top surface coupled to the first exterior surface and to the first and second side surfaces;

a bottom surface coupled to the first exterior surface and to the first and second side surfaces;

a second exterior surface coupled to the first and second side surfaces, to the top surface, and to the bottom surface;

a wooden attachment layer integrally formed within and substantially covering at least one of the first and second exterior surfaces;

wherein the building block comprises a mixture of water, cement, acrylic fortifier, and insulative material in the proportions of:

20.4 to 29.5 kg (45 to 65 lb) water;

36.3 to 47.6 kg (80 to 105 lb) cement;

0.59 to 0.83 liters (2.5 to 3.5 cups) acrylic fortifier; and 265 to 303 liters (70 to 80 gallons) insulative material.

15. The building block of claim 14 wherein the wooden attachment layer comprises oriented strand board (OSB).

16. The building block of claim 14 further comprising at least one substantially cylindrical passage extending from the top surface to the bottom surface.

* * * * *